US006474594B1

(12) United States Patent
Johnson et al.

(10) Patent No.: US 6,474,594 B1
(45) Date of Patent: Nov. 5, 2002

(54) OUTPUT SHAFT ASSEMBLY FOR A MISSILE CONTROL ACTUATION UNIT

(75) Inventors: Gary H. Johnson; Christopher P. Owan; William M. Hatalsky; Wayne Lee Sunne, all of Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/854,273

(22) Filed: May 11, 2001

(51) Int. Cl.[7] ..... F42B 10/00
(52) U.S. Cl. ..... 244/3.24; 244/3.28
(58) Field of Search ..... 244/3.24, 3.28, 244/3.29, 3.25, 90 R, 87, 39

(56) References Cited

U.S. PATENT DOCUMENTS 3,650,496 A * 3/1972 Svensson ..... 244/3.29
4,568,041 A 2/1986 Whitham ..... 244/3.25
4,655,420 A 4/1987 Spiroff ..... 244/3.24
4,884,766 A * 12/1989 Steinmetz et al. ..... 244/3.27
5,255,882 A * 10/1993 Schroppel ..... 192/141
5,593,109 A * 1/1997 Williams ..... 244/3.21
6,250,584 B1 * 6/2001 Hsu et al. ..... 244/3.21
6,398,156 B2 * 6/2002 Hetzer et al. ..... 244/3.24

* cited by examiner

*Primary Examiner*—J. Woodrow Eldred
(74) *Attorney, Agent, or Firm*—Renner, Otto, Boisselle & Sklar, LLP

(57) ABSTRACT

Accordingly, a shaft assembly for coupling a control fin to a missile includes outer and inner shaft portions which are detachably coupled together, allowing removal of one of the shaft portions while the other shaft portion remains in the missile. In an exemplary embodiment, the inner shaft portion, to which the control fin is coupled, is removable. The shaft assembly includes a pair of preload nuts to adjust the position of the control fin relative to the skin of the missile, the preload nuts being for example engaged on opposite threaded ends of the outer shaft portion.

21 Claims, 4 Drawing Sheets

OUTPUT SHAFT ASSEMBLY FOR A MISSILE CONTROL ACTUATION UNIT

RIGHTS OF THE GOVERNMENT

The invention described herein may be manufactured and used by or for the Government of the United States for all governmental purposes without the payment of any royalty.

FIELD OF THE INVENTION

The present invention relates generally to flight control actuators, and more particularly to an output shaft for a flight control actuation unit. Even more particularly, the present invention relates to a removable output shaft for a missile fin actuator in a missile control actuation unit.

BACKGROUND OF THE INVENTION

Missile control fins are commonly positioned by actuators mounted within the missile body. Each control fin is usually coupled to a corresponding actuator by means of a cylindrical output shaft. The actuator, via the output shaft, exerts appropriate rotational torque and control on the fin so that missile control is achieved. In general, a high degree of torsional and bending stiffness is required of the actuator and its output shaft. Actuators may be electrically, pneumatically, or hydraulically powered, as is known.

A conventional actuator has a large outer bearing and significantly smaller inner bearing. The bearings are spaced apart at a distance D along the actuator output shaft. These bearings allow the shaft to rotate freely, and react to loads imposed by the output shaft as a result of aerodynamic loads on the fin. In conventional actuators, the distance D is the minimum bearing spacing compatible with maximum allowable bearing loads. These bearing loads are transferred to the actuator housing and reacted to by the missile body to achieve the desired missile control (e.g., attitude).

One shortcoming of such a conventional actuator design is that the bending stiffness needed to meet flutter requirements is limited by the small diameter of the inner bearing. As noted above, the diameter of the inner bearing is significantly smaller than the diameter of the outer bearing. The limited bending stiffness results, for example, in the onset of aerodynamic instability (flutter) at reduced airspeeds.

Another shortcoming of such a conventional actuator design is that the resultant reduced bending load capability reduces the maneuverability of the missile by reducing the loads which can be transferred to the bearings via the output shaft.

Yet another shortcoming of the conventional actuator design is the requirement for high manufacturing tolerances. Such high manufacturing tolerances are due, in part, to the unitary design of the actuation unit housing.

The conventional housing is usually a solid piece of aluminum in which several holes are bored out to receive each actuator unit and corresponding output shaft. A counter bore is required to produce a retaining shoulder to hold the smaller inner bearing. In the past, a counter bore of this nature could not be done automatically by a computer programmed boring machine. It had to be done manually, which drove up manufacturing costs. In addition, the unitary design made it difficult to service the output shafts in the field. This required that the entire missile be shipped back to the manufacture for servicing.

Further, the unitary design of the actuation unit housing makes it difficult to test actuators in the assembled units as required before delivery to a customer. Additionally, the unitary design made it difficult to test new missile fin attachment stub designs. In each of these sorts of tests, the missile actuation unit has to be taken substantially apart.

As a consequence, a need exists for improvement in actuation unit construction to reduce the cost associated with using, manufacturing, testing and servicing the output shaft of a missile control actuation unit and thereby eliminate costly corrective measures required to be taken as a result thereof.

SUMMARY OF THE INVENTION

The present invention provides an output shaft for a missile fin actuator in a missile control actuation unit designed to satisfy the aforementioned needs.

Accordingly, a shaft assembly for coupling a control fin to a missile includes outer and inner shaft portions which are detachably coupled together, allowing removal of one of the shaft portions while the other shaft portion remains in the missile. In an exemplary embodiment, the inner shaft portion, to which the control fin is coupled, is removable. The shaft assembly includes a pair of preload nuts which serve to adjust the position of the control fin relative to the skin of the missile, as well as to provide necessary bearing preload. The preload nuts may for example be engaged on opposite threaded ends of the outer shaft portion.

According to an aspect of the invention, a shaft assembly for coupling a control fin to a missile includes outer and inner shaft portions which are detachably coupled together. In an embodiment of the invention, the shaft portions are coupled together by means of a fastener.

According to another aspect of the invention, a shaft assembly for coupling a control fin to a missile includes a pair of bearings, the bearing closer to the center of the missile having approximately the same diameter as a bearing farther from the center of the missile.

According to still another aspect of the invention, a shaft assembly for coupling a control fin to a missile includes a shaft and a pair of preload nuts threadedly engaged with the shaft at respective opposite ends of the shaft. In an embodiment of the invention, the shaft includes an inner shaft portion coupled to an outer shaft portion, and the preload nuts are threadedly engaged with the outer shaft portion.

According to yet another aspect of the invention, a shaft assembly for coupling a control fin to a missile includes an inner shaft, an outer shaft detachably coupled to the inner shaft, and a pair of bearings coupled to the outer shaft for enabling rotation of the outer shaft relative to the missile.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
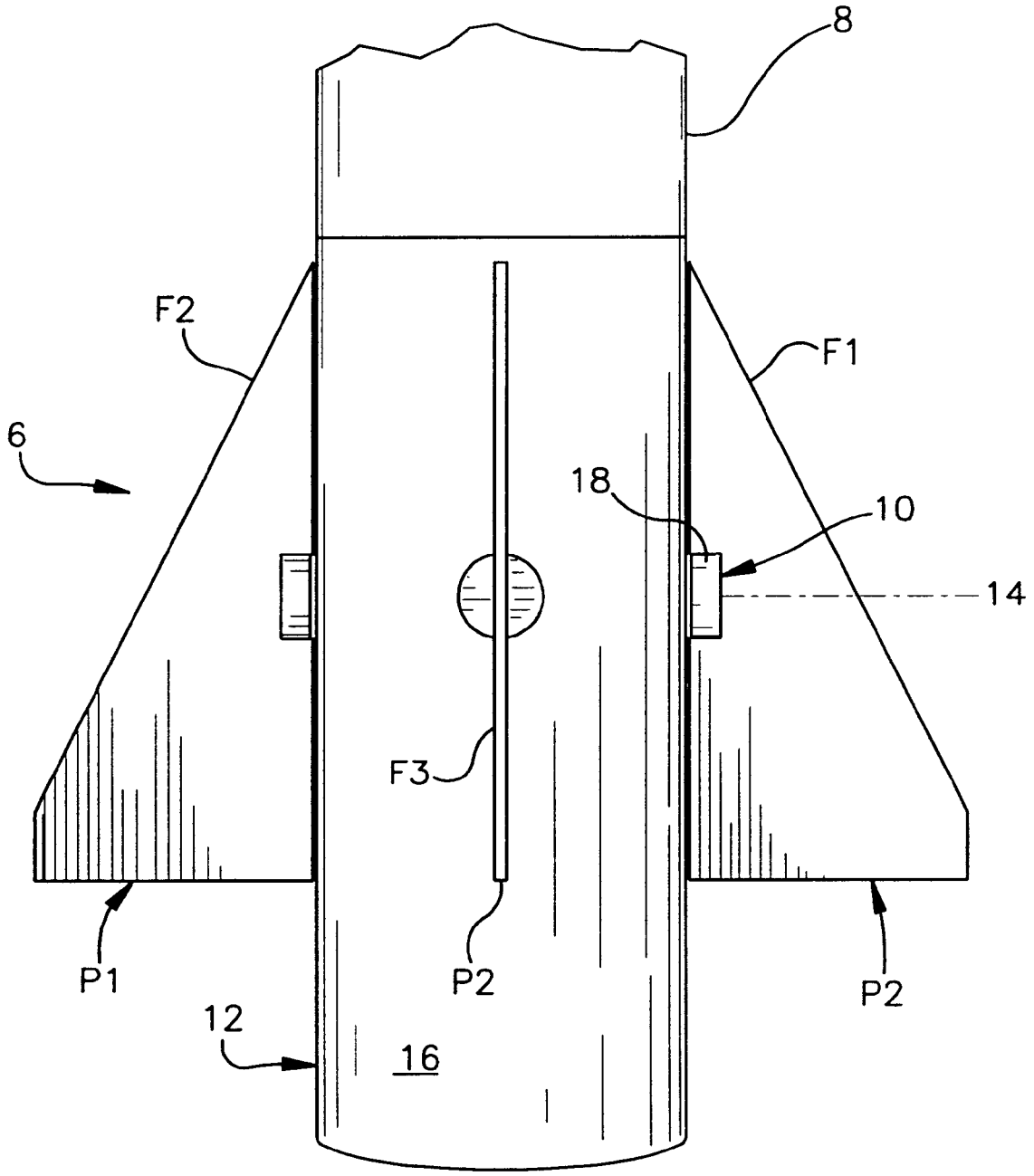
FIG. 1 is a perspective view of the flight control actuation unit of a missile, including four missile fin control surfaces that maneuver the missile by use of shaft assemblies in accordance with the present invention.

Referring initially to FIG. 1, a missile control actuation unit 6 is shown which is a part of or is mounted on a portion of a missile body 8. The missile control actuation unit 6 may be at an end or at an intermediate location on the missile body 8. The actuation unit 6 secures and provides means to rotate a number of control fins F1–F3 of the missile. Although only the three control fins F1–F3 are visible in FIG. 1, it will be appreciated that the control fins will in general be evenly spaced around the circumference of the missile body 8, and that therefore the missile control actuation unit 6 includes a fourth control fin F4 which is hidden from view. For each of the control fins F1–F4, the control actuation unit 6 has a shaft assembly, such as the shaft assembly 10, to which the fin is coupled (or integral with) and which is partially inserted into, and which extends outwardly from, a missile control actuation unit body 12. The shaft assembly 10 is mounted in the body 12 in a suitable manner to allow rotation about an axis 14 of the shaft assembly. As shown, the axis 14 may extend substantially normally from a skin 16 of the body 12. The shaft assembly 10 may have a fin attachment stub 18 for receiving and securing one of the control fins F1–F4. Alternatively, as mentioned above, one of the control fins may be integrally formed with the shaft assembly.

As explained in greater detail below, the shaft assembly 10 has multiple shaft parts that facilitate assembly and disassembly of the control actuation unit 6, in particular facilitating easy removal and replacement of all or part of the shaft assembly from the control actuation unit. Further, the multiple shaft parts of the shaft assembly 10 are coupled together by a pin, which advantageously provides low output backlash. In addition, the shaft assembly 10 includes adjustment means (a pair of bearing preload nuts) to adjust the position of the fin attachment stub 18 and the fin relative to the skin 16 of the body 12. The preload nuts may provide a "back to back" preload on the bearings, which is advantageous in terms of increasing the bending stiffness of the output shaft.

Each of the shaft assemblies rotates as commanded by a guidance control computer, to thereby rotate its corresponding control fin, enabling the missile to maneuver. In the exemplary embodiment, four missile fins are substantially symmetrically arrayed about the circumference of the missile 8. The guidance control computer may be used to provide a torque command for rotation of each fin separately in accordance with known tracking algorithms. Alternatively or in addition, the guidance control computer may be used to provide one torque command for common rotation of a pair of opposed fins.

Figure 2:
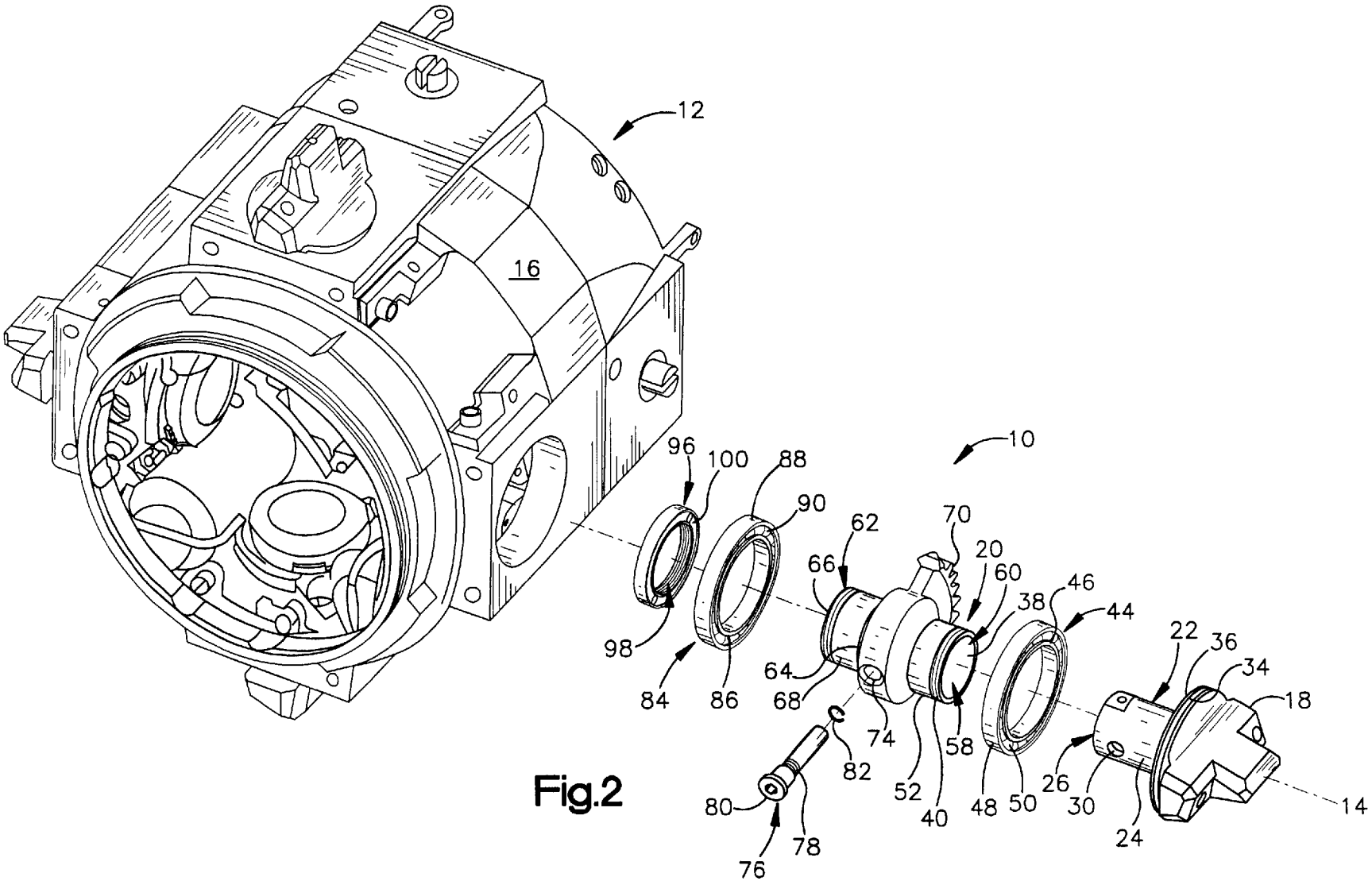
FIG. 2 is an exploded perspective view of a shaft assembly of FIG. 1.
Figure 3:
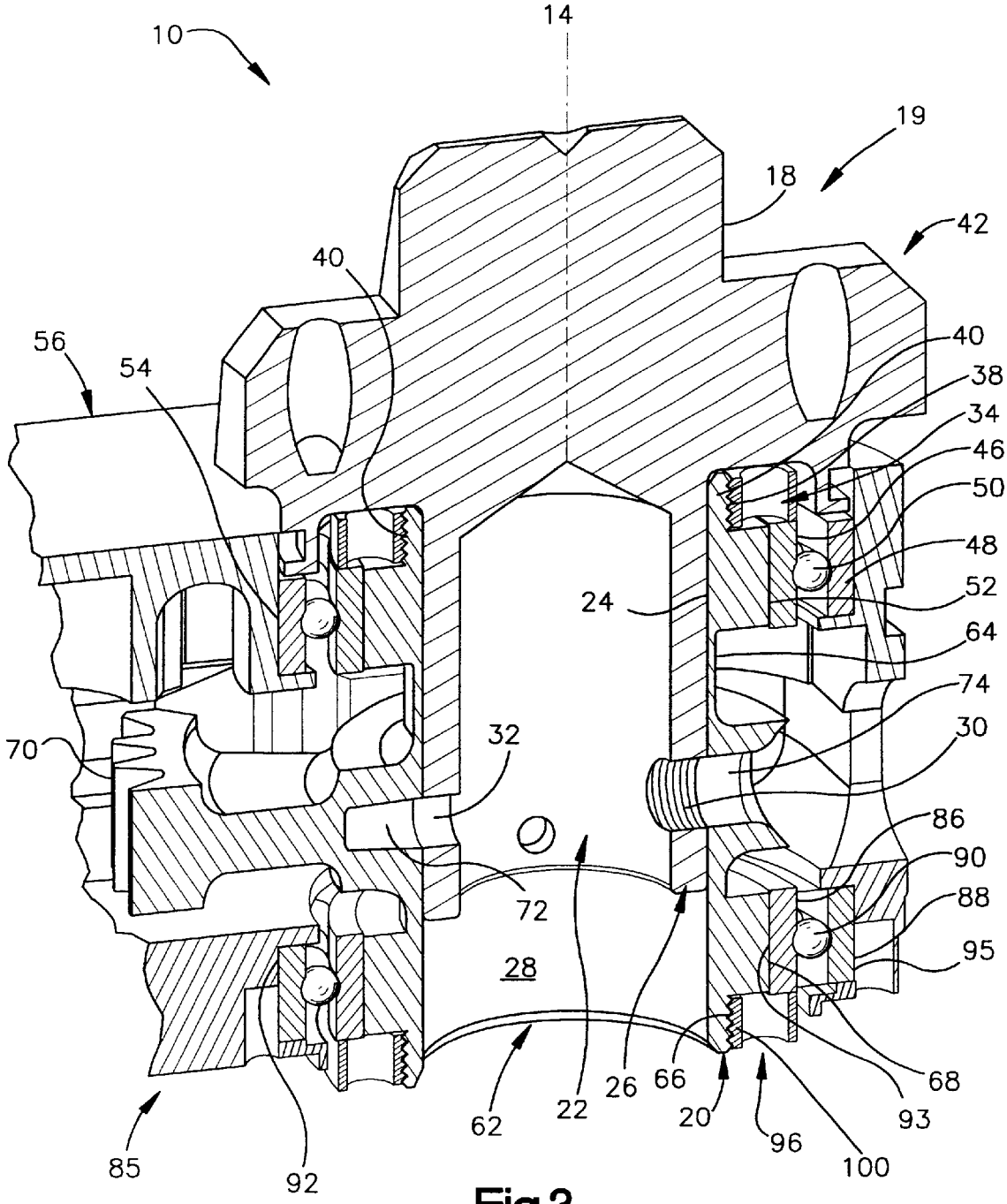
FIGS. 3 and 4 are sectional perspective views of the shaft assembly of FIG.1 installed in a housing of a missile.
Figure 4:
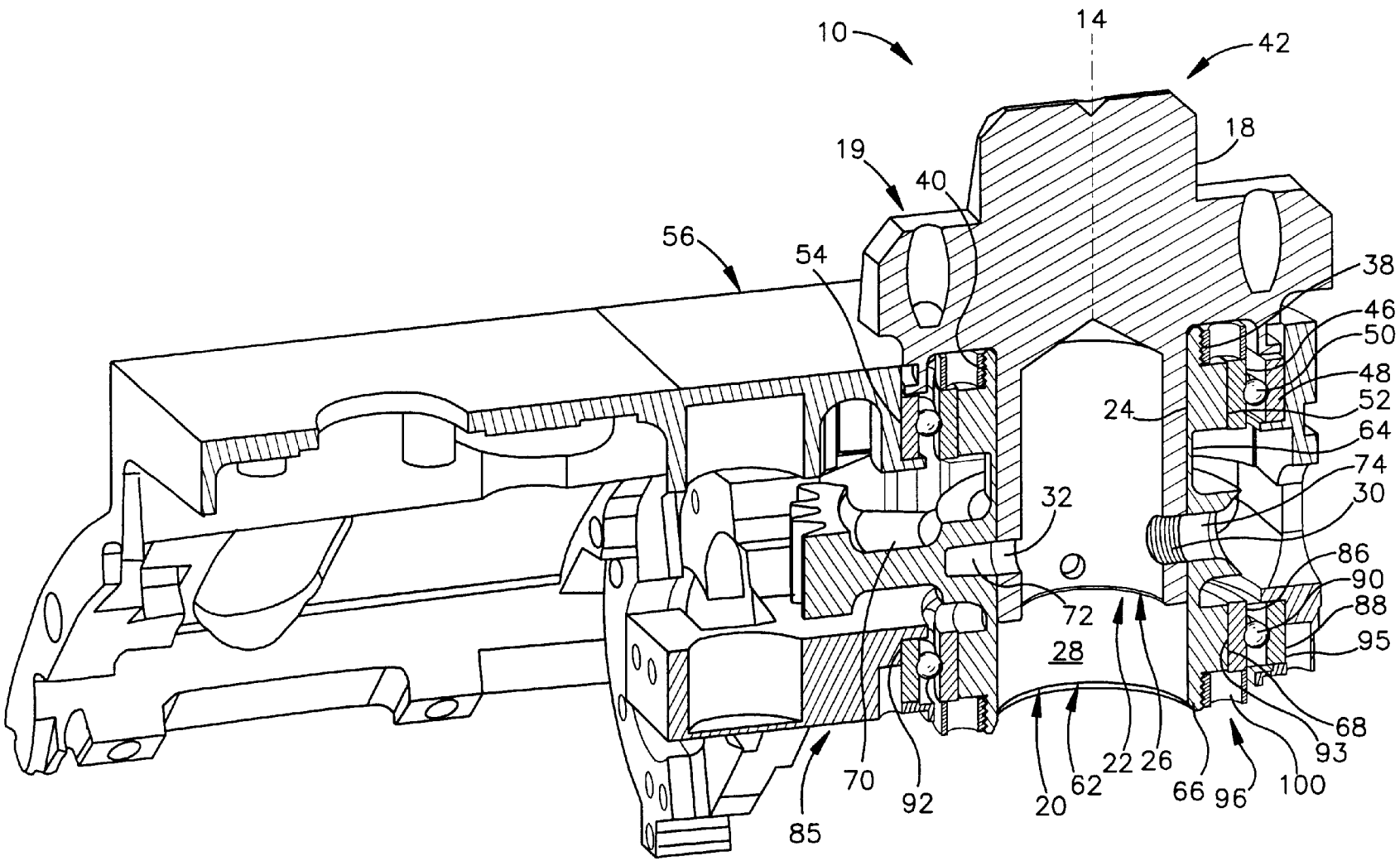

Referring to FIGS. 2–4, details of the shaft assembly 10 are shown. The shaft assembly 10 includes a shaft 19 made up of an outer shaft portion 20 (also referred to as an outer shaft) and an inner shaft portion 22 (also referred to as an inner shaft). As is described more fully below, the inner shaft 22 is received by and detachably connected to the outer shaft 20.

In the following description, the terms "outer" and "inner" are generally used in reference to relative distance from the axis 14 of the shaft assembly 10. By contrast, the terms "distal" and "proximal" are generally used in reference to relative distance from the axis of the missile body 8.

The fin attachment stub 18 is fixedly mounted to the inner shaft 22 for receiving and securing a control fin along the axis 14. It will be appreciated that the fin attachment stub 18 may either be an integral part of the inner shaft 22, or may be a separate part which is attached or otherwise coupled to the inner shaft. Alternatively, as mentioned above, a fin and the inner shaft may be integrally formed.

The inner shaft 22 has a cylindrical portion 24 which has an open, non-accessible axial end 26. The open end 26 is within the body 12, inside the skin 16, when the inner shaft 22 is detachably connected to the outer shaft 20 and the shaft assembly 10 is installed in the body. The open end 26 may include a circular opening about the axis 14 of shaft assembly 10. The cylindrical portion 24 is an external cylindrical surface, which is substantially coaxial with and slidable within an internal cylindrical surface 28 of the outer shaft 20. The cylindrical portion 24 of the inner shaft 22 and the internal cylindrical surface 28 of the outer shaft 20 are aligned therewith along the axis 14 when the inner shaft is detachably connected to outer shaft.

The cylindrical portion 24 of the inner shaft 22 has pair of diametrically-opposed holes 30 and 32 (also referred to as "bores"). The hole 30 is internally threaded. As described below, the holes 30 and 32 are used in detachably securing the outer shaft 20 to the inner shaft 22.

A distal preload nut 34 has a central, generally circular, opening 36 which is somewhat larger in diameter than the cylindrical portion 24 of the inner shaft 22. The cylindrical portion 24 extends centrally through the distal nut 34 without engagement therewith when the inner shaft 22 is inserted through the distal nut 34 and into the outer shaft 20. The distal nut 34 has an internal threaded surface 38 which engages an external threaded end 40 of the outer shaft 20. The engagement of the distal nut 34 and the threaded end 40 is used in adjusting the position of the fin attachment stub 18, and more particulary the fin, relative to the skin 16. This adjustment process is described in greater detail below.

The shaft assembly 10 has a distal bearing 44 which includes an inner race 46, an outer race 48, and a plurality of balls 50 between the races to allow the races to rotate relative to one another. The inner race 46 is associated with and rotates with a cylindrical outer bearing shoulder surface 52 of outer shaft 20. The outer race 48 is associated with and is stationary relative to a cylindrical surface 54 of a distal housing portion 56 into which the shaft assembly 10 assembly is inserted. The distal bearing 44 is thus disposed radially between the cylindrical surface 52 and the cylindrical surface 54, and allows low friction rotation of the outer shaft 20 relative to the distal housing portion 56.

The outer shaft 20 defines the generally circular socket 58, coincident axially with the axis 14, into which the inner shaft 22 is inserted. The inner shaft 22 extends centrally into and is circumscribed by the socket 58, thus juxtaposing both the inner shaft 22 and the outer shaft 20 coaxially along the axis 14.

The socket 58 includes a cylindrical interior surface 28 which has open ends 60 and 62 at respective opposite sides of the outer shaft 20. The open end 60 is disposed in a distal direction from the axis of the body 12. The open end 60 is accessible when the inner shaft 22 is detached and removed from the outer shaft 20, and it is into the open end 60 where the inner shaft is inserted for assembly of the shaft assembly 10. The open end 62 is proximal relative to the open end 60.

The outer shaft 20 has an externally threaded end 66 about the open end 60, the external threaded end 66 abutting a cylindrical surface 68. The cylindrical surface 68 is larger in diameter than open end 62, and extends therefrom toward the open end 60 a substantial portion of the distance therebetween. Between the cylindrical surfaces 52 and 68, the outer shaft 20 has an integrally formed partial gear 70. When the shaft assembly 10 is installed, the partial gear 70 is operatively coupled to other gearing and components for rotating the shaft assembly. In an exemplary embodiment, the partial gear 70 has an angular spread of approximately 80°.

The partial gear 70 has a receiving hole or bore 72, and a through-hole or bore 74 which is diametrically opposed to the receiving hole 72. The through-hole 74 is counterbored at the exterior of the outer shaft 20. The holes 72 and 74, in conjunction with the holes 30 and 32 of the inner shaft 22, are used to detachably couple the inner shaft to the outer shaft 20. A fastener such as a bolt or tension element 76 is slidably received through the holes 30, 32, 72, and 74. The bolt 76 has an externally-threaded portion 78 which engages the threads of the internally-threaded hole 30. The bolt 76 has a bolt head 80 disposed outwardly of the hole 74. The bolt head 80 is larger in diameter than the balance of the bolt 76, and may be configured in a manner for engagement by a suitable corresponding driving tool, for rotational manipulation of the bolt. The bolt 76 may be secured in place by use of a securing device such as a locking ring 82 which is received in a suitable annular groove in the bolt, adjacent to the hole 32 of the inner shaft 22. This locking ring 82 serves to retain the bolt 76, thereby maintaining the outer shaft 20 and the inner shaft 22 coupled together.

It will be appreciated that a wide variety of other known suitable means for detachably coupling the shafts 20 and 22 alternatively may be employed.

A proximal bearing 84 allows low-friction rotation of the outer shaft 20 relative a proximal housing portion 85. The proximal bearing 84 includes an inner race 86, an outer race 88, and a plurality of balls 90 mounting the races for rotation relative to one another. The inner race 86 is associated with and rotates with the cylindrical outer bearing shoulder surface 68. The proximal bearing 84 is disposed radially between cylindrical surface 68 and a cylindrical inner surface 92 of the proximal housing portion 85. An interior surface 93 of the inner race 86, and the exterior surface 68 of the outer shaft 20, conform and are engaged with each other. Similarly, an exterior surface 95 of the outer race 88 and the inner surface 92 of the proximal housing portion 84 conform and are engaged with each other.

The proximal bearing 84 has a diameter similar to that of the distal bearing 44, although it will be appreciated that alternatively other configurations may be employed.

A proximal preload nut 96 has a central opening 98, which in turn has an internal threaded surface 100. The threaded surface 100 engages the external threaded end 66 of the outer shaft 20. The proximal preload nut 96 bears against the inner race 86 of the proximal bearing 84. Similarly, the distal preload nut 34 bears against the inner race 46 of the distal bearing 44. Thus the position of the preload nuts 34 and 96 relative to (along) the outer shaft 20 positions the shaft assembly 10 relative to the skin 16. By adjusting the position of the preload nuts 34 and 96 along the outer shaft 20, the position of the fin attachment stub 18, and thus the corresponding fin, relative to the skin 16, may be controlled. It will be appreciated that the adjustment of the position of the preload nuts 34 and 96 along the outer shaft 20 may be effected by rotation of the nuts and/or rotation of the outer shaft. Therefore desired adjustment in fin placement relative to the skin 16 may easily be made. Such adjustment may be desirable, for example, to vary performance or to compensate for the inevitable non-zero manufacturing tolerances. It will be appreciated that the easy adjustment of the fin position increases flexibility in use of the missile, and may allow increased manufacturing tolerances, thereby providing a means of facilitating fabrication and reducing manufacturing costs.

The assembly and operation of shaft assembly 10 is briefly reviewed at this point with reference to FIGS. 1–4. Prior to insertion of the inner shaft 22, the bearings 44 and 84 are secured relative to the outer shaft 20 by use of the preload nuts 34 and 96. In doing so, the distal preload nut 34 is rotated in the appropriate direction to threadedly engage the internal threaded surface 38 with the external threaded end 40 until proper engagement is made with the inner race 46. Next the proximal preload nut 96 is rotated in the appropriate direction to threadedly engage its internal threaded surface 100 with the external threaded end 66 until proper engagement with the inner race 86. The proximal preload nut 96 is tightened with a suitable torque to provide a desired "back to back" bearing preload.

Then, with one of the fins F1 detached from body 12 of missile control actuation unit 6, the corresponding inner shaft 22 mounted on the fin is aligned with the corresponding axis 14 and positioned thereabout so that the axis of bores 72 and 74 of the outer shaft will be aligned with the bores 30 and 32 of the inner shaft 22 when the inner shaft 22 is received in the socket 58. The inner shaft 22 is then inserted into the socket 58 until the bores 30 and 32 are aligned with the bores 70 and 72. The bolt 76 is then aligned with the corresponding axes of the holes 72 and 74 of the outer shaft 22 and with holes 30 and 32 of the inner shaft 22. The bolt 76 is then inserted through the holes until the threaded portion 78 reaches the threads of the threaded hole 30. The bolt 76 is then rotated in the appropriate direction to threadedly engage its portion 78 with the threaded hole 30 and draw the bolt head 80 into engagement with the surface 64. It is apparent that the holes 72, 74, 30, and 32 are engagable by the bolt portion 78 only when outer shaft 20 and inner shaft 22 are positioned so as to align the holes. Further rotation of the bolt 76 securely fixes the outer shaft 20 and the inner shaft 22 so that the fin attachment stub 18 and the fin F1 thereon are fixedly positioned along and angularly about the axis 14 in relation to the outer shaft 20.

It is apparent that the distal preload nut 34 and the proximal preload nut 96 are selectively engagable with the outer shaft 20 and rotatable to move the fin F1 distally and proximally relative to the skin 16 of the body 12.

When it is desired to detach one of the fins F1–F4, the corresponding bolt 76 is rotated in the opposite direction from the direction for attaching the fin and removed from the holes 30, 32, 72, and 74. The fin attachment stub 18 and the inner shaft 22 are thus released from the outer shaft 20 so that the inner shaft 22 may be removed from the socket 58. When the inner shaft 22 is removed from the socket 58, the bearings 44 and 84 may then be conveniently removed from socket 26 by rotating the preload nuts 34 and 96 in the opposite direction from the direction for attaching the nuts to the outer shaft 20.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A shaft assembly for coupling a control fin to a missile, the shaft assembly comprising:

a shaft; and a pair of preload nuts threadedly engaged with the shaft at respective opposite ends of the shaft.

2. The shaft assembly of claim 1, wherein the shaft includes an inner shaft portion coupled to an outer shaft portion.

3. The shaft assembly of claim 2, wherein the preload nuts are threadedly engaged with the outer shaft portion.

4. The shaft assembly of claim 2, further comprising means for detachably coupling the shaft portions together.

5. The shaft assembly of claim 2, wherein the inner shaft portion has a pair of diametrically-opposed holes therethrough and the outer shaft has a through hole and has a receiving hole diametrically opposed to the through hole, and further comprising a fastener which is inserted through the diametrically-opposed holes and the through hole, and which is inserted into the receiving hole, to thereby detachably couple the shaft portions together.

6. The shaft assembly of claim 5, wherein one of the diametrically-opposed holes an internally-threaded diametrically-opposed hole, and the fastener has a threaded portion for engaging the internally-threaded diametrically-opposed hole.

7. The shaft assembly of claim 6, further comprising a locking ring coupled to the fastener.

8. The shaft assembly of claim 1, further comprising a partial gear operatively coupled to the shaft, wherein the partial gear is operatively configured to be coupled to a control system of the missile to enable rotation of the shaft and the fin relative to the missile.

9. The shaft assembly of claim 8, wherein the partial gear is integrally formed with an outer shaft portion of the shaft.

10. The shaft assembly of claim 1, further comprising a proximal bearing and a distal bearing, each of the bearings coupled to the shaft, wherein the proximal bearing is operatively configured to be closer than the distal bearing to a center of the missile when the shaft assembly is installed in the missile.

11. The shaft assembly of claim 10, wherein a diameter the proximal bearing is similar to a diameter of the distal bearing.

12. The shaft assembly of claim 10, wherein the preload nuts press against inner races of respective of the bearings.

13. The shaft assembly of claim 1, wherein the shaft includes a fin attachment stub.

14. A shaft assembly for coupling a control fin to a missile, the shaft assembly comprising:

an inner shaft;

an outer shaft detachably coupled to the inner shaft; and a pair of bearings coupled to the outer shaft for enabling rotation of the outer shaft relative to the missile.

15. The shaft assembly of claim 14, wherein the pair of bearings include a proximal bearing and a distal bearing, and wherein the proximal bearing is operatively configured to be closer than the distal bearing to a center of the missile when the shaft assembly is installed in the missile.

16. The shaft assembly of claim 15, wherein a diameter the proximal bearing is similar to a diameter of the distal bearing.

17. The shaft assembly of claim 14, further comprising a pair of preload nuts threadedly engaged with respective opposite ends of the outer shaft.

18. The shaft assembly of claim 17, wherein each of the preload nuts presses against an inner race of respective of the bearings.

19. The shaft assembly of claim 14, wherein the inner shaft portion has a pair of diametrically-opposed through holes, and the outer shaft has an additional through hole and a receiving hole diametrically opposed to the additional through hole, and further comprising a fastener which is inserted through the diametrically-opposed holes and the through hole, and which is inserted into the receiving hole, to thereby detachably couple the shaft portions together.

20. The shaft assembly of claim 19, wherein one of the diametrically-opposed holes an internally-threaded diametrically-opposed hole, and the fastener has a threaded portion for engaging the internally-threaded diametrically-opposed hole.

21. The shaft assembly of claim 14, wherein the inner shaft includes a fin attachment stub.

* * * * *